US010205256B2

(12) United States Patent
Wu et al.

(10) Patent No.: US 10,205,256 B2
(45) Date of Patent: Feb. 12, 2019

(54) PLUG AND ELECTRICAL CONNECTOR COMPONENT

(71) Applicants: Luxshare Precision Industry Co., Ltd, Shenzhen (CN); Huawei Technologies Co., Ltd, Shenzhen (CN)

(72) Inventors: Xingde Wu, Shenzhen (CN); Jiangbo Li, Shenzhen (CN); Wen Liu, Shenzhen (CN); Long Jin, Shenzhen (CN); Tiesheng Li, Shenzhen (CN); Yue Wang, Shenzhen (CN); Jun Wu, Shenzhen (CN); Wanxing Wang, Shenzhen (CN)

(73) Assignees: Huawei Technologies Co., Ltd (CN); Luxshare Precision Industry Co., Ltd (CN)

( * ) Notice: Subject to any disclaimer, the term of this patent is extended or adjusted under 35 U.S.C. 154(b) by 0 days.

(21) Appl. No.: 15/923,025

(22) Filed: Mar. 16, 2018

(65) Prior Publication Data

US 2018/0269607 A1 Sep. 20, 2018

(30) Foreign Application Priority Data

Mar. 16, 2017 (CN) ..... 2017 2 0258731
Apr. 1, 2017 (CN) ..... 2017 2 0443445

(51) Int. Cl.
*H01R 12/00* (2006.01)
*H01R 12/70* (2011.01)
*H01R 12/77* (2011.01)

(52) U.S. Cl.
CPC ..... *H01R 12/7005* (2013.01); *H01R 12/7023* (2013.01); *H01R 12/777* (2013.01)

(58) Field of Classification Search
CPC ..... H01R 12/7005; H01R 12/7023; H01R 12/777
(Continued)

(56) References Cited

U.S. PATENT DOCUMENTS 7,303,438 B2 * 12/2007 Dawiedczyk ..... H01R 12/7005 439/358
7,367,812 B2 * 5/2008 Shih ..... H01R 13/6275 439/374
(Continued)

FOREIGN PATENT DOCUMENTS

CN 2699521 Y 5/2005
CN 2728025 Y 9/2005
(Continued)

*Primary Examiner* — Khiem Nguyen
(74) *Attorney, Agent, or Firm* — Woodard Emhardt Moriarty McNett & Henry LLP

(57) ABSTRACT

Provided are a plug and an electrical connector component. The plug includes an insulating body, a circuit board fixed to the insulating body, and a cable electrically connected with the circuit board and extending backwards from the insulating body. The insulating body includes a body part and a mating part which extends forwards from the body part; the circuit board has an inserting part that protrudes forwards out of the mating part; metal contact pieces are distributed on upper and lower surfaces of the inserting part; the insulating body is provided with a pair of baffle plates extending forwards from the body part; a pair of the baffle plates are respectively arranged on left and right sides of the mating part; and a limiting groove configured to guide the insertion of the plug with the socket is formed between each of the baffle plates and the mating part.

20 Claims, 5 Drawing Sheets

(58) Field of Classification Search
USPC ..... 439/62, 77, 374, 630
See application file for complete search history.

(56) References Cited

U.S. PATENT DOCUMENTS

| | | | | |
|---|---|---|---|---|
| 8,834,185 | B2 * | 9/2014 | Wu | H01R 9/2408 439/76.1 |
| 9,017,092 | B1 * | 4/2015 | McCracken | H01R 13/62 439/374 |
| 2018/0212364 | A1 | 7/2018 | Huang et al. | |

FOREIGN PATENT DOCUMENTS

| | | | |
|---|---|---|---|
| CN | 202076461 | U | 12/2011 |
| CN | 203026692 | U | 6/2013 |
| CN | 103633488 | A | 3/2014 |
| CN | 205429310 | U | 8/2016 |
| CN | 205429310 | U | 8/2016 |
| CN | 205811129 | U | 12/2016 |
| CN | 206471599 | U | 9/2017 |
| TW | M427693 | U | 4/2012 |
| TW | M551363 | U | 11/2017 |

* cited by examiner

PLUG AND ELECTRICAL CONNECTOR COMPONENT

CROSS-REFERENCE TO RELATED APPLICATIONS

This application claims priority to Chinese Patent Application No. 201720443445.6 filed on Apr. 1, 2017 and Chinese Patent Application No. 201720258731.5 filed on Mar. 16, 2017, the disclosures of which are incorporated herein by reference in their entireties.

TECHNICAL FIELD

The present disclosure relates to the technical field of connectors, and particularly relates to a plug having a circuit board and an electrical connector component.

BACKGROUND

In the related prior art, an electrical connector component is disclosed in a Chinese utility model patent with application number of CN205429310U. The electrical connector component includes a plug and a socket. The plug includes a circuit board, an insulating body and a cable. The circuit board is horizontally placed, and has a mating end and a connecting end which are opposed in a front-rear direction. Metal contact pieces are distributed on an upper surface and a lower surface of the mating end. The mating end forwards protrudes from the insulating body, and the connecting end is fixed into the insulating body. A front end of the cable is electrically connected with the connecting end, and a rear end of the cable extends backwards out of the insulating body.

The socket includes an insulating seat body, a plurality of conductive terminals accommodated in the insulating seat body, and a metal shell that encloses the insulating seat body. The insulating seat body is provided with a slot. The conductive terminals have arc-shaped contact parts that extend into the slot and welding feet that extend from the insulating seat body. The contact parts are arranged in the slot in two rows (an upper row and a lower row). The metal shell includes a top wall, a bottom wall and two side walls which cover an outer side of the insulating seat body. The top wall, the bottom wall and the two side walls forwards protrude from the insulating seat body. An inserting hole is formed among the top wall, the bottom wall and the two side walls. The inserting hole is located in front of the slot, and the inserting hole and the slot are communicated in the front-rear direction. When the plug is inserted into the socket, the front end of the insulating body is inserted into the inserting hole and the mating end of the circuit board is inserted into the slot so that the contact pieces and the contact parts form elastic contact, thereby realizing electrical connection. However, when a space of a client mechanism is narrow and a size of the plug is made to be very short, since the plug is easy to be inserted obliquely due to the stress of the cable at the time of inserting and pulling the plug, the circuit board mates with the contact parts of the conductive terminals and a risk of PIN collapse exists.

Therefore, it is necessary to design a new plug and electrical connector component to solve the above technical problems.

SUMMARY

The present disclosure aims to propose a plug and an electrical connector component capable of reducing a risk of PIN collapse. To achieve the above purpose, the present disclosure adopts the technical solution described below.

A plug includes an insulating body, a circuit board fixed to the insulating body, and a cable electrically connected with the circuit board and extending backwards from the insulating body, wherein the insulating body includes a body part and a mating part which extends forwards from the body part; the circuit board has an inserting part that protrudes forwards out of the mating part; metal contact pieces are distributed on an upper surface and a lower surface of the inserting part; the insulating body is also provided with a pair of baffle plates that extend forwards from the body part; a pair of the baffle plates are respectively arranged on a left side and a right side of the mating part; and a limiting groove configured to guide the insertion of the plug with the socket is formed between each of the baffle plates and the mating part.

In some embodiments, the limiting groove penetrates through the insulating body in an up-down direction and a forward direction; and the inserting part and the limiting groove are staggered in a front-rear direction.

Further, each of the baffle plates is provided with a front end surface, and the front end surface exceeds the mating part forwards.

In some embodiments, a front end surface of the inserting part forwards exceeds the front end surfaces of the baffle plates; or the front end surfaces of the baffle plates tend to be flush with the front end surface of the inserting part.

In some embodiments, each of the baffle plate is also provided with an upper guiding surface that extends from the front end surface backwards and upwards and a lower guiding surface that extends from the front end surface backwards and downwards; and the front end surface, the upper guiding surface and the lower guiding surface are in smooth connection.

In some embodiments, the body part has a limiting block that protrudes forwards into the limiting groove.

In some embodiments, each of the baffle plates includes a side baffle plate and an upper baffle plate vertically connected with the side baffle plate; and the upper baffle plate horizontally extends from an upper end of the side baffle plate to an inner side, and is located above the mating part; and the limiting groove includes a side limiting groove formed between the mating part and the side baffle plate and an upper limiting groove formed between the mating part and the upper baffle plate; and the side limiting groove is communicated with the upper limiting groove.

In some embodiments, a front end surface of the side baffle plate tends to be flush with the front end surface of the upper baffle plate; and the front end surface of the side baffle plate and the front end surface of the upper baffle plate forwards exceed the mating part.

In some embodiments, the front end surface of the inserting part forwards exceeds the front end surface of the side baffle plate and the front end surface of the upper baffle plate; or the front end surface of the side baffle plate and the front end surface of the upper baffle plate tend to be flush with the front end surface of the inserting part.

In some embodiments, the limiting groove includes a side limiting groove formed between the mating part and the side baffle plate and an upper limiting groove formed between the mating part and the upper baffle plate; and the side limiting groove is communicated with the upper limiting groove.

In some embodiments, bar-shaped grooves are formed in the inner side of the side limiting groove and the inner side of the upper limiting groove.

In some embodiments, the plug also includes a metal limiting housing which is clamped with an outer side surface of the insulating body; and the side baffle plate and the upper baffle plate are located on the metal limiting housing.

An electrical connector component includes a socket and the above plug, wherein the socket includes an insulating seat body, a conductive terminal accommodated into the insulating seat body, and a metal shell for accommodating the insulating seat body; the insulating seat body is provided with a slot into which the inserting part is inserted; the conductive terminal has a contact part that extends into the slot; the metal shell includes a top wall, a bottom wall and two side walls which cover an outer side of the insulating seat body; the top wall, the bottom wall and the two side walls forwards protrude out of the insulating seat body; an inserting hole into which the mating part is inserted is formed among the top wall, the bottom wall and the two side walls; the inserting hole is located in front of the slot and is communicated with the slot in a front-rear direction; and the two limiting grooves respectively guide insertion of the corresponding side walls.

An electrical connector component includes a socket and the above plug, wherein the socket includes an insulating seat body, a conductive terminal accommodated into the insulating seat body, and a metal shell for accommodating the insulating seat body; the insulating seat body is provided with a slot into which the inserting part is inserted; the conductive terminal has a contact part that extends into the slot; the metal shell includes a top wall, a bottom wall and two side walls which cover an outer side of the insulating seat body; the top wall, the bottom wall and the two side walls forwards protrude out of the insulating seat body; an inserting hole into which the mating part is inserted is formed among the top wall, the bottom wall and the two side walls; the inserting hole is located in front of the slot and is communicated with the slot in a front-rear direction; the side limiting groove guides insertion of the side walls; and the upper limiting groove guides insertion of the top wall.

The present disclosure has the beneficial effects that: the limiting groove is used to guide the insertion of the plug with the socket, thereby effectively preventing the plug from being inserted obliquely, preventing the inserting part of the circuit board from mating with the contact part of the conductive terminal and reducing the risk of PIN collapse of the electrical connector.

DETAILED DESCRIPTION

Figure 1:
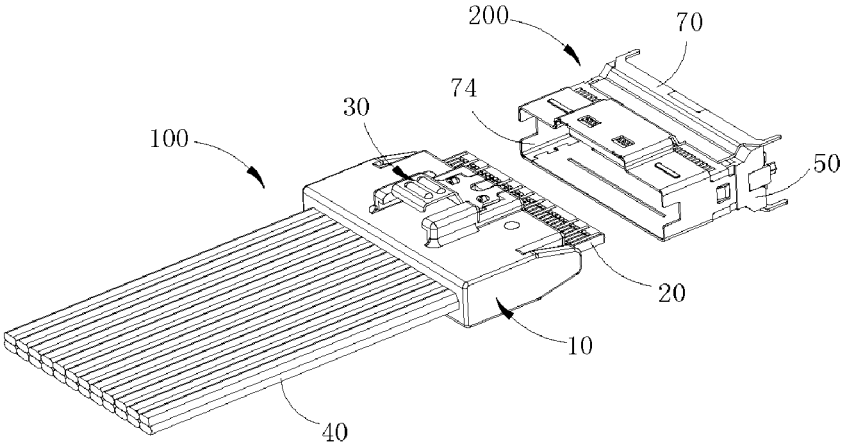
FIG. 1 is a schematic diagram illustrating an explosion structure of an electrical connector component provided in an embodiment of the present disclosure.

The technical solution of the present disclosure will be further described below in combination with drawings through specific embodiments. Parts discussed include:

insulating body 10
body part 11
mating part 12
baffle plate 13
limiting groove 14
limiting block 15
metal limiting housing 16
circuit board 20
inserting part 22
metal contact piece 25
metal latch piece 30
elastic piece 31
pressing piece 32
cable 40
insulating seat body 50
slot 52
conductive terminal 60
contact part 62
metal shell 70
top wall 71
bottom wall 72
side wall 73
inserting hole 74
plug 100
front end surface 131
upper guiding surface 132
lower guiding surface 133
side baffle plate 134
upper baffle plate 135
side limiting groove 141
upper limiting groove 142
elastic lug 161
socket 200
latch bulge part 311
latch hole 711
limiting hole 735

As shown in FIG. 1, the electrical connector component of an embodiment of the present disclosure includes a plug 100 and a socket 200.

Figure 9:
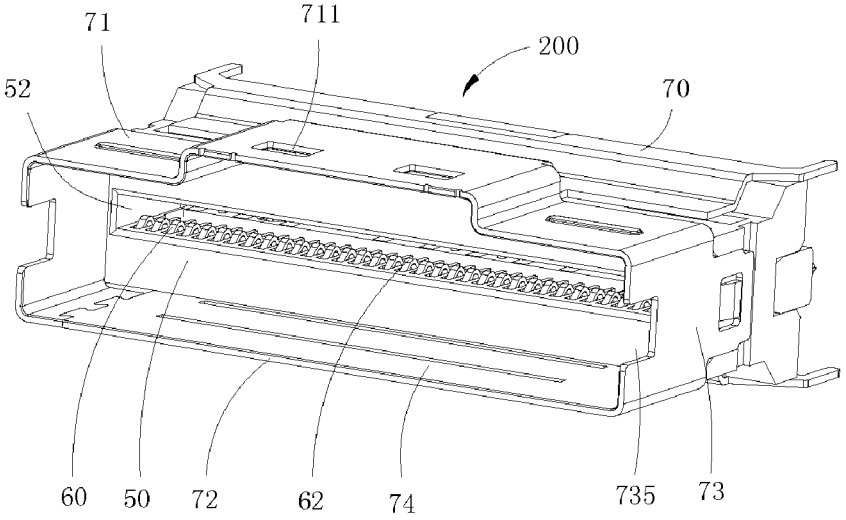
FIG. 9 is a structural schematic diagram illustrating a socket in FIG. 1.

As shown in FIG. 9, the socket 200 includes an insulating seat body 50, a conductive terminal 60 accommodated into the insulating seat body 50, and a metal shell 70 for accommodating the insulating seat body 50. A slot 52 is formed in the insulating seat body 50. The conductive terminal 60 has arc-shaped contact parts 62 that protrude into the slot 52 and welding feet (not shown) which extend out of the insulating seat body 50. The contact parts 62 are arranged in the slot 52 in two rows (an upper row and a lower row). The metal shell 70 includes a top wall 71 coated on an outer side of the insulating seat body 50, a bottom wall 72 and two side walls 73. The top wall 71, the bottom wall 72 and the two side walls 73 forwards protrude out of the insulating seat body 50. An inserting hole 74 is formed among the top wall 71, the bottom wall 72 and the two side walls 73. The inserting hole 74 is located in front of the slot 52 and is communicated with the slot 52 in a front-rear direction.

Figure 2:
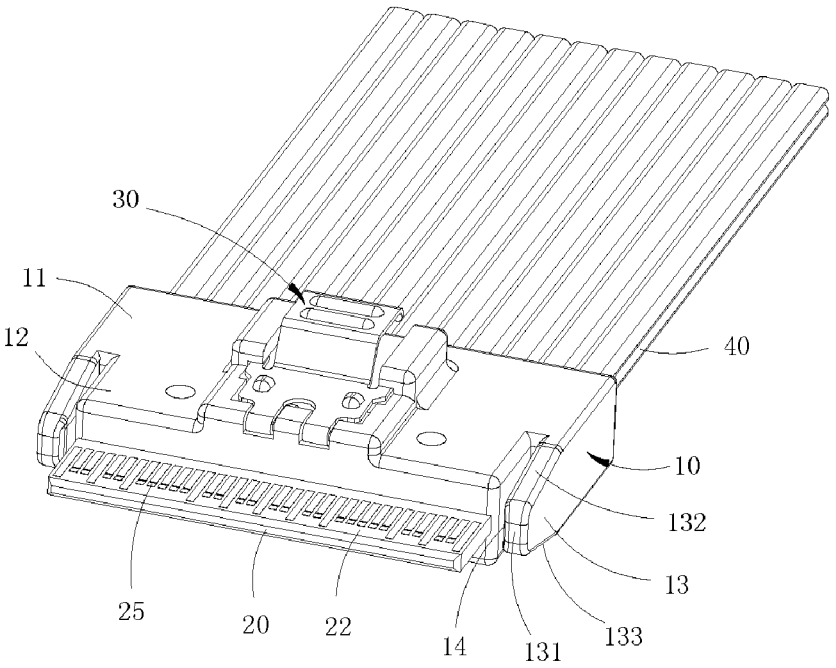
FIG. 2 is a three-dimensional structural schematic diagram illustrating an embodiment 1 of a plug in FIG. 1.

As shown in FIG. 2, the plug 100 includes an insulating body 10, a circuit board 20 fixed to the insulating body 10, a metal latch piece 30 latched to the socket 200, and a cable 40 electrically connected with the circuit board 20 and extending backwards from the insulating body 10. The insulating body 10 includes a body part 11 and a mating part 12 which extends forwards from the body part 11. The rear end of the circuit board 20 is embedded into the insulating body 10, and is electrically connected with the cable 40. The circuit board 20 has an inserting part 22 that protrudes forwards out of the mating part 12. Metal contact pieces 25 are distributed on an upper surface and a lower surface of the inserting part 22. The insulating body 10 is also provided with a pair of baffle plates 13 that extend forwards from the body part 11. The pair of the baffle plates 13 is respectively arranged on a left side and a right side of the mating part 12; and a limiting groove 14 is formed between each of the baffle plates 13 and the mating part 12.

When the plug 100 is inserted into the socket 200, the inserting part 22 penetrates through the inserting hole 74 and is inserted into the slot 52; the contact parts 62 of the conductive terminal 60 mate with the corresponding metal contact pieces 25; and the mating part 12 is inserted into the inserting hole 74. The two limiting grooves 14 of the plug 100 respectively guide the insertion of the two side walls 73 of the socket 200, thereby realizing accurate insertion between the plug 100 and the socket 200, effectively preventing the plug 100 from being inserted obliquely, thus preventing the inserting part 22 of the circuit board 20 of the plug 100 from being damaging the contact parts 62 of the conductive terminal 60 of the socket 200, and reducing the risk of PIN collapse of the electrical connector.

For the convenience of guiding the insertion between the plug 100 and the socket 200, the limiting groove 14 penetrates through the insulating body 10 in an up-down direction and a forward direction. The inserting part 22 and the limiting groove 14 are staggered in a front-rear direction, so as to avoid interference when the side wall 73 is inserted into the corresponding limiting groove 14.

To further enhance accuracy and stability of the insertion between the plug 100 and the socket 200, the body part 11 is provided with a limiting block 15 that protrudes forwards into the limiting groove 14. The side wall 73 is provided with a limiting hole 735 adapted with the shape of the limiting block 15, and the limiting block 15 is inserted into the corresponding limiting hole 735. The limiting block 15 can be arranged on an inner bottom surface of the limiting groove 14, and can also be arranged on an inner side surface of the limiting groove 14.

Figure 3:
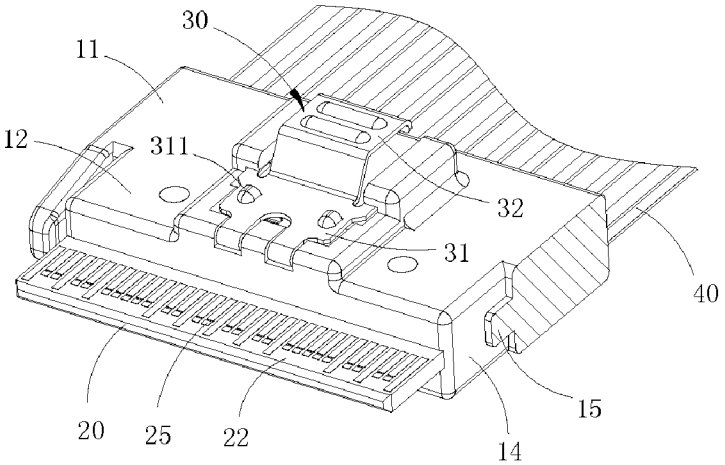
FIG. 3 is a sectional view illustrating the embodiment 1 of the plug in FIG. 1.

In the plug 100, as shown in FIG. 3, the metal latch piece 30 is arranged on the top surface of the insulating body 10 and includes an elastic piece 31 and a pressing piece 32 located on a rear end of the elastic piece 31. An upper surface of the elastic piece 31 is provided with a latch bulge part 311, and the elastic piece 31 can drive the latch bulge part 311 to elastically swing up and down. During insertion, the latch bulge part 311 is latched in a latch hole 711 formed in the metal shell 70. When the plug 100 is pulled out, the pressing piece 32 is manually pressed to drive the elastic piece 31 to swing downwards, and the latch bulge part 311 moves out of the latch hole 711.

In a first embodiment of the present disclosure as shown in FIG. 2 and FIG. 3, in the plug 100, the baffle plate 13 is an erect plate-shaped structure, is integrally formed with the insulating body 10 and is provided with a front end surface 131, an upper guiding surface 132 and a lower guiding surface 133. The front end surface 131 forwards exceeds the mating part 12; and a front end surface of the inserting part 22 forwards exceeds the front end surfaces 131 of the baffle plates 13. The adoption of the structure enables the plug 100 to be conveniently inserted into the socket 200, and accurate insertion between the plug 100 and the socket 200 can be realized under the limit of the limiting groove 14 and the limiting block 15.

Figure 4:
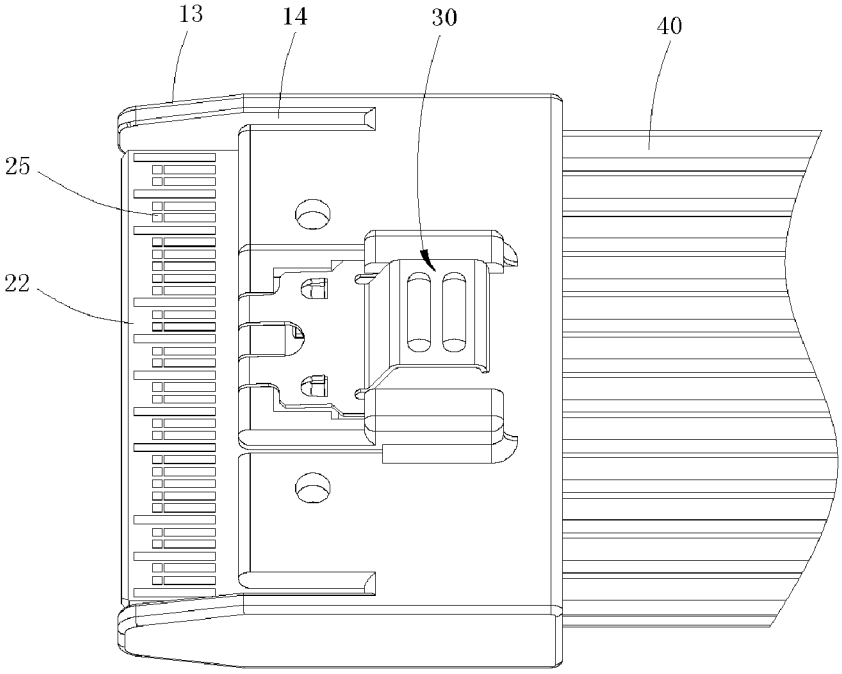
FIG. 4 is a structural schematic diagram illustrating an embodiment 2 of the plug in FIG. 1.

In a second embodiment of the present disclosure as shown in FIG. 4, the front end surfaces 131 of the baffle plates 13 tend to be flush with the front end surface of the inserting part 22. The adoption of the structure enables accurate insertion between the plug 100 and the socket 200 under the limit of the limiting groove 14 and the limiting block 15, and an inserting structure is stable. In addition, the two baffle plates 13 can also protect the inserting part 22 of the circuit board 20.

In above two embodiments, the front end surfaces 131 of the baffle plates 13 are erect planes or arc-shaped surfaces that protrude forwards. The upper guiding surface 132 of the baffle plate 13 extends from the front end surface 131 backwards and upwards; the lower guiding surface 133 of the baffle plate 13 extends from the front end surface 131 backwards and downwards; and the front end surface 131, the upper guiding surface 132 and the lower guiding surface 133 are in smooth connection, so as to reduce contact area between the baffle plate 13 and the socket 200, thereby reducing the friction during the insertion and pulling actions between the plug 100 and the socket 200, and prolonging the service life of the electrical connector.

Figure 5:
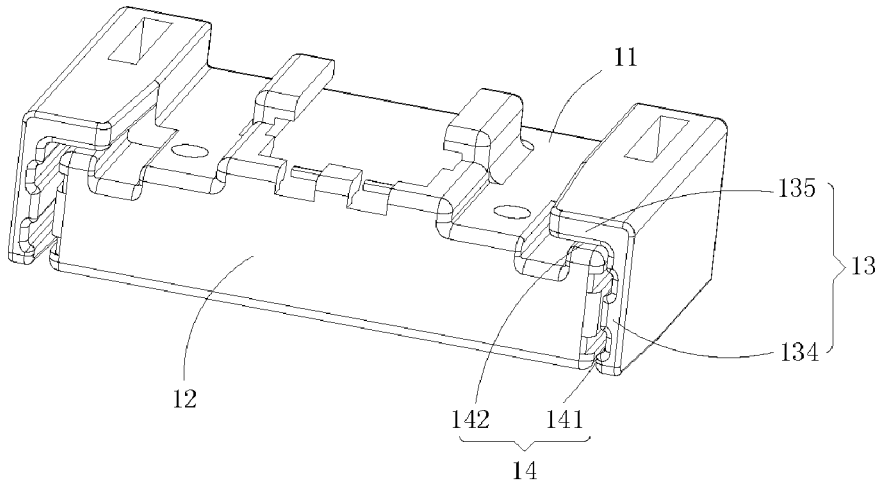
FIG. 5 is a structural schematic diagram illustrating an embodiment 3 of the plug in FIG. 1 (a circuit board and a cable are not shown)

In a third embodiment of the present disclosure as shown in FIG. 5, in the plug 100, each of the baffle plates 13 includes a side baffle plate 134 and an upper baffle plate 135 vertically connected with the side baffle plate 134; and the upper baffle plate 135 horizontally extends from an upper end of the side baffle plate 134 to an inner side, and is located above the mating part 12. The limiting groove 14 includes a side limiting groove 141 formed between the side baffle plate 134 and the mating part 12 and an upper limiting groove 142 formed between the upper baffle plate 135 and the mating part 12. The side limiting groove 141 is configured to guide insertion of the side walls 73; the upper limiting groove 142 is configured to guide insertion of the top wall 71; and the side limiting groove 141 is communicated with the upper limiting groove 142. A front end surface of the side baffle plate 134 tends to be flush with the front end surface of the upper baffle plate 135. The front end surface of the side baffle plate 134 and the front end surface of the upper baffle plate 135 forwards exceed the mating part 12. The front end surface of the inserting part 22 forwards exceeds the front end surface of the side baffle plate 134 and the front end surface of the upper baffle plate 135. The adoption of the structure enables the plug 100 to be conveniently inserted into the socket 200, and accurate insertion between the plug 100 and the socket 200 can be realized under the limit of the side limiting groove 141, the upper limiting groove 142 and the limiting block 15.

Figure 6:
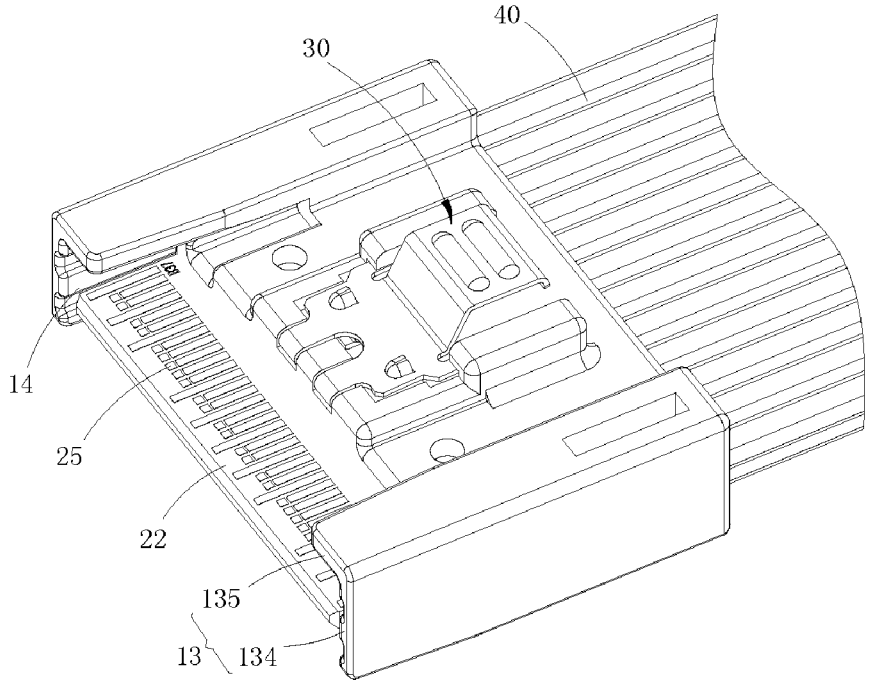
FIG. 6 is a structural schematic diagram illustrating an embodiment 4 of the plug in FIG. 1.

In a fourth embodiment of the present disclosure as shown in FIG. 6, in the plug 100, the front end surface of the side baffle plate 134 and the front end surface of the upper baffle plate 135 tend to be flush with the front end surface of the inserting part 22. The adoption of the structure enables accurate insertion between the plug 100 and the socket 200 under the limit of the side limiting groove 141, the upper limiting groove 142 and the limiting block 15; and an inserting structure is stable. In addition, the two baffle plates 13 can also protect the inserting part 22 of the circuit board 20.

In above third and fourth embodiments, for the convenience of inserting the side walls 73 into the side limiting groove 141 and inserting the top wall 71 into the upper limiting groove 142, bar-shaped grooves may be formed in the inner side of the side limiting groove 141 and the inner side of the upper limiting groove 142, so as to reduce contact area between the insulating body 10 and the side walls 73 as well as the top wall 71.

Figure 7:
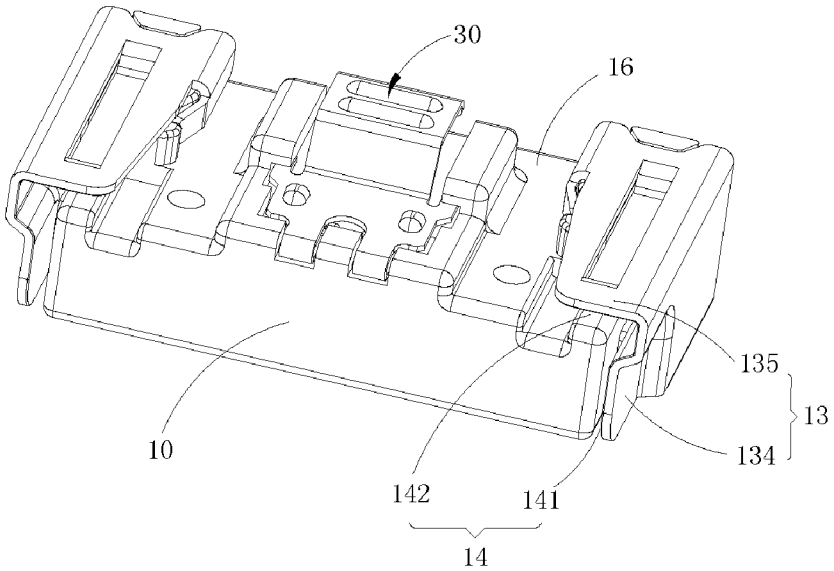
FIG. 7 is a three-dimensional structural schematic diagram illustrating an embodiment 5 of the plug in FIG. 1 (a circuit board and a cable are not shown)
Figure 8:
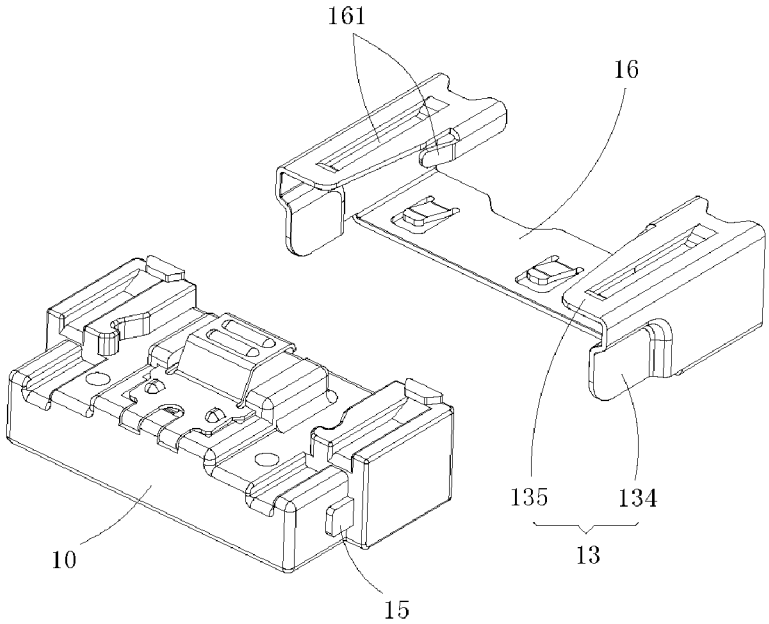
FIG. 8 is a schematic diagram illustrating an explosion structure of an embodiment 5 of the plug in FIG. 1 (a circuit board and a cable are not shown)

In a fifth embodiment of the present disclosure as shown in FIG. 7 and FIG. 8, in the plug 100, the plug 100 also includes a metal limiting housing 16. The side baffle plate 134 and the upper baffle plate 135 are located on the metal limiting housing 16, and are integrally formed with the metal limiting housing 16. The metal limiting housing 16 is clamped with an outer side surface of the insulating body 10 through the elastic lug 161 arranged on the side part.

Technical principles of the present disclosure are described above in combination with specific embodiments. These descriptions are only used to explain the principles of the present disclosure, and are not interpreted as limitations to a protection scope of the present disclosure in any way. Based on explanation herein, those skilled in the art can contemplate other specific embodiments of the present disclosure without contributing creative labor. These embodiments shall fall into the protection scope of the present disclosure.

What is claimed is:

1. A plug, comprising an insulating body, a circuit board fixed to the insulating body, and a cable electrically connected with the circuit board and extending backwards from the insulating body, wherein the insulating body comprises a body part and a mating part which extends forwards from the body part; the circuit board has an inserting part that protrudes forwards out of the mating part; a plurality of metal contact pieces are distributed on an upper surface and a lower surface of the inserting part, wherein the insulating body is further provided with a pair of baffle plates that extend forwards from the body part; a pair of the baffle plates are respectively arranged on a left side and a right side of the mating part; and a limiting groove configured to guide the insertion of the plug is formed between each of the baffle plates and the mating part.

2. The plug according to claim 1, wherein the limiting groove penetrates through the insulating body in an up-down direction and a forward direction; and the inserting part and the limiting groove are staggered in a front-rear direction.

3. The plug according to claim 1, wherein each of the baffle plates is provided with a front end surface, and the front end surface forwards exceeds the mating part.

4. The plug according to claim 3, wherein a front end surface of the inserting part forwards exceeds the front end surfaces of the baffle plates; or the front end surfaces of the baffle plates tend to be flush with the front end surface of the inserting part.

5. The plug according to claim 3, wherein each of the baffle plates is further provided with an upper guiding surface that extends from the front end surface backwards and upwards and a lower guiding surface that extends from the front end surface backwards and downwards; and the front end surface, the upper guiding surface and the lower guiding surface are in smooth connection.

6. The plug according to claim 1, wherein the body part has a limiting block that protrudes forwards into the limiting groove.

7. The plug according to claim 1, wherein each of the baffle plates comprises a side baffle plate and an upper baffle plate vertically connected with the side baffle plate; and the upper baffle plate horizontally extends from an upper end of the side baffle plate to an inner side, and is located above the mating part; and the limiting groove comprises a side limiting groove formed between the mating part and the side baffle plate and an upper limiting groove formed between the mating part and the upper baffle plate; the side limiting groove is communicated with the upper limiting groove.

8. The plug according to claim 7, wherein a front end surface of the side baffle plate tends to be flush with the front end surface of the upper baffle plate; and the front end surface of the side baffle plate and the front end surface of the upper baffle plate forwards exceed the mating part.

9. The plug according to claim 8, wherein the front end surface of the inserting part forwards exceeds the front end surface of the side baffle plate and the front end surface of the upper baffle plate; or the front end surface of the side baffle plate and the front end surface of the upper baffle plate tend to be flush with the front end surface of the inserting part.

10. The plug according to claim 7, wherein bar-shaped grooves are formed in the inner side of the side limiting groove and the inner side of the upper limiting groove.

11. The plug according to claim 7, wherein the plug further comprises a metal limiting housing which is clamped with an outer side surface of the insulating body; the side baffle plate and the upper baffle plate are located on the metal limiting housing.

12. An electrical connector component, comprising a socket and a plug, wherein the plug comprises an insulating body, a circuit board fixed to the insulating body, and a cable electrically connected with the circuit board and extending backwards from the insulating body, wherein the insulating body comprises a body part and a mating part which extends forwards from the body part; the circuit board has an inserting part that protrudes forwards out of the mating part; a plurality of metal contact pieces are distributed on an upper surface and a lower surface of the inserting part, wherein the insulating body is further provided with a pair of baffle plates that extend forwards from the body part; a pair of the baffle plates are respectively arranged on a left side and a right side of the mating part; and a limiting groove configured to guide the insertion of the plug is formed between each of the baffle plates and the mating part, wherein the socket comprises an insulating seat body, a conductive terminal accommodated into the insulating seat body, and a metal shell for accommodating the insulating seat body; the insulating seat body is provided with a slot into which the inserting part is inserted; the conductive terminal has a contact part that extends into the slot; the metal shell comprises a top wall, a bottom wall and two side walls which cover an outer side of the insulating seat body; the top wall, the bottom wall and the two side walls forwards protrude out of the insulating seat body; an inserting hole into which the mating part is inserted is formed among the top wall, the bottom wall and the two side walls; the inserting hole is located in front of the slot and is communicated with the slot in a front-rear direction; and the two limiting grooves respectively guide insertion of the corresponding side walls.

13. An electrical connector component, comprising a socket and a plug, wherein the plug comprises an insulating body, a circuit board fixed to the insulating body, and a cable electrically connected with the circuit board and extending backwards from the insulating body, wherein the insulating body comprises a body part and a mating part which extends forwards from the body part; the circuit board has an inserting part that protrudes forwards out of the mating part; a plurality of metal contact pieces are distributed on an upper surface and a lower surface of the inserting part, wherein the insulating body is further provided with a pair of baffle plates that extend forwards from the body part; a pair of the baffle plates are respectively arranged on a left side and a right side of the mating part; and a limiting groove configured to guide the insertion of the plug is formed between each of the baffle plates and the mating part, wherein each of the baffle plates comprises a side baffle plate and an upper baffle plate vertically connected with the side baffle plate; and the upper baffle plate horizontally extends from an upper end of the side baffle plate to an inner side, and is located above the mating part; and the limiting groove comprises a side limiting groove formed between the mating part and the side baffle plate and an upper limiting groove formed between the mating part and the upper baffle plate; the side limiting groove is communicated with the upper limiting groove, wherein the socket comprises an insulating seat body, a conductive terminal accommodated into the insulating seat body, and a metal shell for accommodating the insulating seat body; the insulating seat body is provided with a slot into which the inserting part is inserted; the conductive terminal has a contact part that extends into the slot; the metal shell comprises a top wall, a bottom wall and two side walls which cover an outer side of the insulating seat body; the top wall, the bottom wall and the two side walls forwards protrude out of the insulating seat body; an inserting hole into which the mating part is inserted is formed among the top wall, the bottom wall and the two side walls; the inserting hole is located in front of the slot and is communicated with the slot in a front-rear direction; the side limiting groove guides insertion of the side walls; and the upper limiting groove guides insertion of the top wall.

14. The electrical connector component according to claim 12, wherein the limiting groove penetrates through the insulating body in an up-down direction and a forward direction; and the inserting part and the limiting groove are staggered in a front-rear direction.

15. The electrical connector component according to claim 12, wherein each of the baffle plates is provided with a front end surface, and the front end surface forwards exceeds the mating part.

16. The electrical connector component according to claim 15, wherein a front end surface of the inserting part forwards exceeds the front end surfaces of the baffle plates; or the front end surfaces of the baffle plates tend to be flush with the front end surface of the inserting part.

17. The electrical connector component according to claim 15, wherein each of the baffle plates is further provided with an upper guiding surface that extends from the front end surface backwards and upwards and a lower guiding surface that extends from the front end surface backwards and downwards; and the front end surface, the upper guiding surface and the lower guiding surface are in smooth connection.

18. The electrical connector component according to claim 12, wherein the body part has a limiting block that protrudes forwards into the limiting groove.

19. The plug according to claim 13, wherein a front end surface of the side baffle plate tends to be flush with the front end surface of the upper baffle plate; and the front end surface of the side baffle plate and the front end surface of the upper baffle plate forwards exceed the mating part.

20. The plug according to claim 19, wherein the front end surface of the inserting part forwards exceeds the front end surface of the side baffle plate and the front end surface of the upper baffle plate; or the front end surface of the side baffle plate and the front end surface of the upper baffle plate tend to be flush with the front end surface of the inserting part.

* * * * *